United States Patent [19]

Conti

[11] 4,314,461

[45] Feb. 9, 1982

[54] KNITTING MACHINE WITH LATCHLESS NEEDLES COOPERATING WITH EXTERNAL HOOK-TYPE ELEMENTS

[76] Inventor: Gianni Conti, Largo Liverani 7, Florence, Italy

[21] Appl. No.: 103,485

[22] Filed: Dec. 14, 1979

[30] Foreign Application Priority Data

Dec. 21, 1978 [IT] Italy ..... 9676 A/78

[51] Int. Cl.[3] ..... D04B 9/02; D04B 35/06

[52] U.S. Cl. ..... 66/13; 66/107; 66/120

[58] Field of Search ..... 66/13, 62, 90, 107, 66/120

[56] References Cited

U.S. PATENT DOCUMENTS

| | | | |
|---|---|---|---|
| 999,074 | 7/1911 | West | 66/107 |
| 1,385,929 | 7/1921 | Scott | 66/13 |
| 1,877,503 | 9/1932 | Gagne | 66/13 |
| 1,887,166 | 11/1932 | Nuber | 66/120 X |
| 2,716,878 | 9/1955 | Morris | 66/120 |
| 3,703,819 | 4/1970 | Townsend et al. | 66/108 R X |

FOREIGN PATENT DOCUMENTS

| | | | |
|---|---|---|---|
| 1940015 | 2/1970 | Fed. Rep. of Germany | 66/107 |
| 251097 | 10/1947 | Switzerland | 66/90 |
| 3774 | of 1880 | United Kingdom | 66/120 |

*Primary Examiner*—Wm. Carter Reynolds
*Attorney, Agent, or Firm*—McGlew and Tuttle

[57] ABSTRACT

A knitting machine includes latchless needles, and selector elements located in positions corresponding therewith. Each selector element comprises a hook-like extension directed towards the needle point and arranged to penetrate into a longitudinal slot in the needle. The selector elements are subjected to sliding movements approximately perpendicular to the needles, together with lifting and lowering movements so that they penetrate into the needle slot, and are lifted in order to take-up the stitch engaged by the needle and to remove it therefrom. Alternatively the selector element can abandon the stitch by lowering its hook-like extension below the plane of formation of the fabric.

7 Claims, 19 Drawing Figures

Fig.5
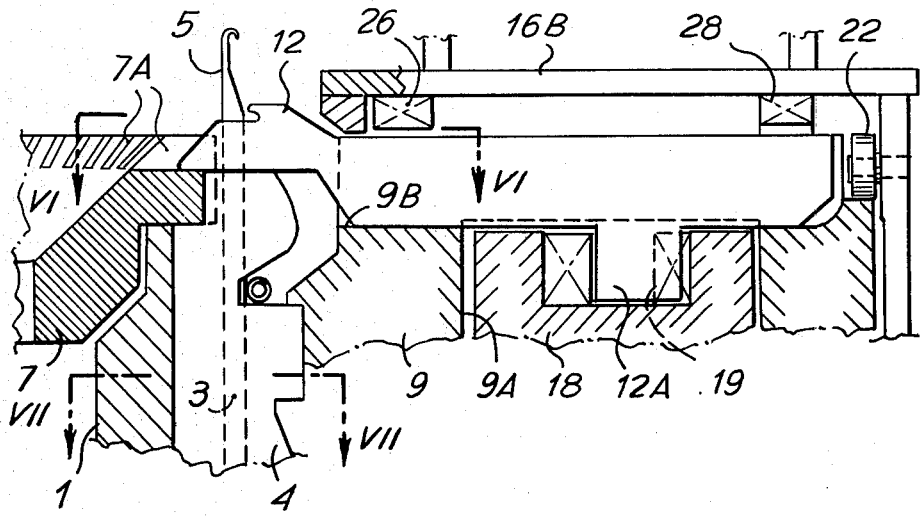
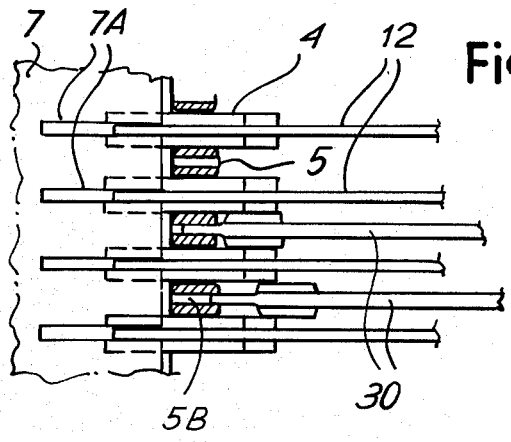
Fig.6
Fig.7
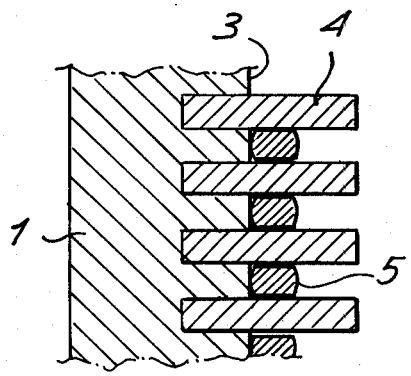

Fig.14
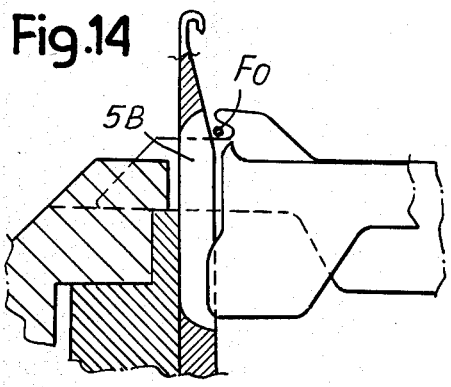
Fig.15
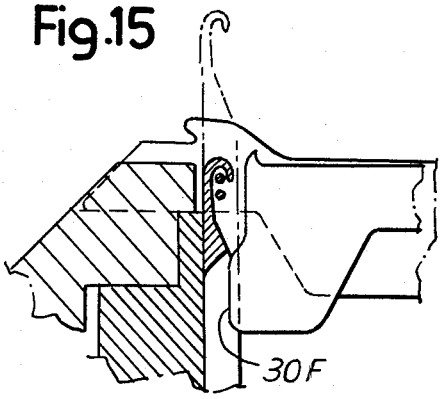
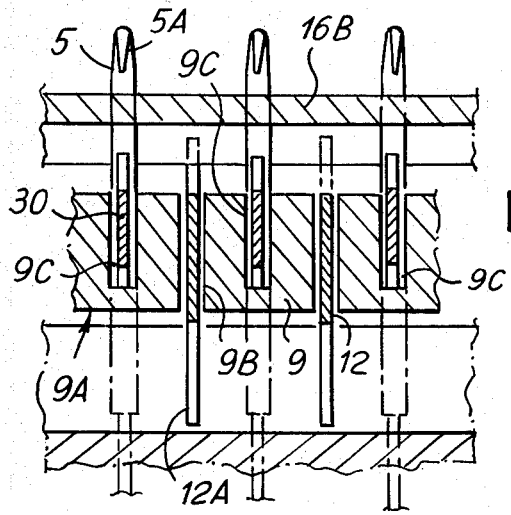
Fig.16
Fig.17
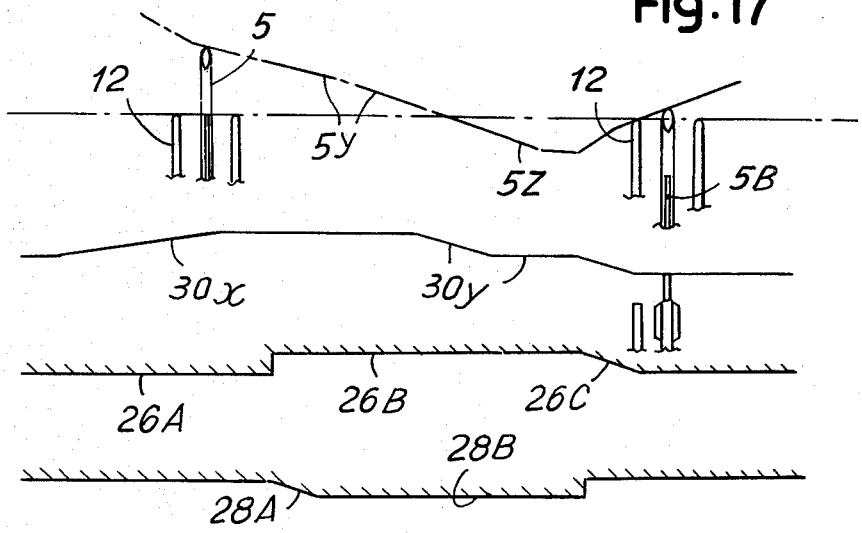

KNITTING MACHINE WITH LATCHLESS NEEDLES COOPERATING WITH EXTERNAL HOOK-TYPE ELEMENTS

BACKGROUND OF THE INVENTION

1. Field of the Invention

The present invention relates to knitting machines, for example circular knitting machines for stockings and socks, large diameter circular knitting machines, and flat bed knitting machines.

2. Description of the Prior Art

Knitting machines conventionally include needles having articulated latches. Latch needles are liable to frequent breakages which result in stoppages in production. Latch needles also cause wear of associated sinkers.

In these conventional machines, needle selection is obtained by raising and lowering the needles, and the stroke length over which the needles must be moved to provide the selection does act to limit the maximum speed attainable by the machine.

SUMMARY OF THE INVENTION

According to the invention, there is provided in a knitting machine, latchless needles each having means defining a longitudinal slot therein, hook-type selector elements slidable generally perpendicularly to the needles and movable between raised and lowered positions perpendicularly to the plane of formation of the fabric, each selector element having a hooked end portion arranged to extend into the said longitudinal slot of an associated needle, and control means selectively operative to move the selector elements generally perpendicularly to the needles and to raise and lower the selector elements so that their hooked end portions can enter the slots in the associated needles and be raised in order to take-up the stitch engaged by the needle and to remove it therefrom, and then be lowered to remove the stitch by lowering the hooked end portion under the plane of formation of the fabric.

The hook-type selector elements can comprise butts arranged to co-operate with two cam contours for providing reciprocating movement of the elements. Each selector element preferably includes single fulcrum by which the element is supported to permit reciprocatory and also pivotal movement. In addition, each element may comprise butts co-operating with the control means.

The control means may move towards the needles, those selector elements which are to take-up the stitch and remove it from the respective needle. The reciprocatory cam contours act at least on those selector elements which are moved forwardly in order to lower each selector element before penetration into the slot in the needle, and to lift it before its removal from the needle, which occurs before the needle is lowered.

The selector elements may each comprise a portion which is always at least partly inserted into the slot in the respective needle. The selector elements can additionally, or alternatively comprise lateral projections co-operating with the sides of the slots in the needles, in order to guide the selector element into the needle slots.

Preferably the selector elements and sinkers are alternately arranged in slots provided in a member—such as an outer ring of a needle cylinder—in which the slots for the sinkers are provided, the sinker control means being located on the opposite side of the member to the control means for the selector elements.

BRIEF DESCRIPTION OF THE DRAWINGS

The invention will now be described, by way of example only, with reference to the accompanying diagrammatic drawings, in which:

FIG. 5 is a section similar to that of FIG. 1, but taken on line V—V of FIG. 2;

FIGS. 6 and 7 are sections on line VI—VI and VII—VII, respectively of FIG. 5;

FIGS. 8 to 15 are fragmentary sections showing an operational sequence of the needles, selector elements and sinkers;

FIG. 16 is a section on line XVI—XVI of FIG. 1;

FIG. 17 shows schematically the relationship between the needle trajectory and the profiles of the cams for controlling the selector elements.

DESCRIPTION OF THE PREFERRED EMBODIMENTS

Figure 1:
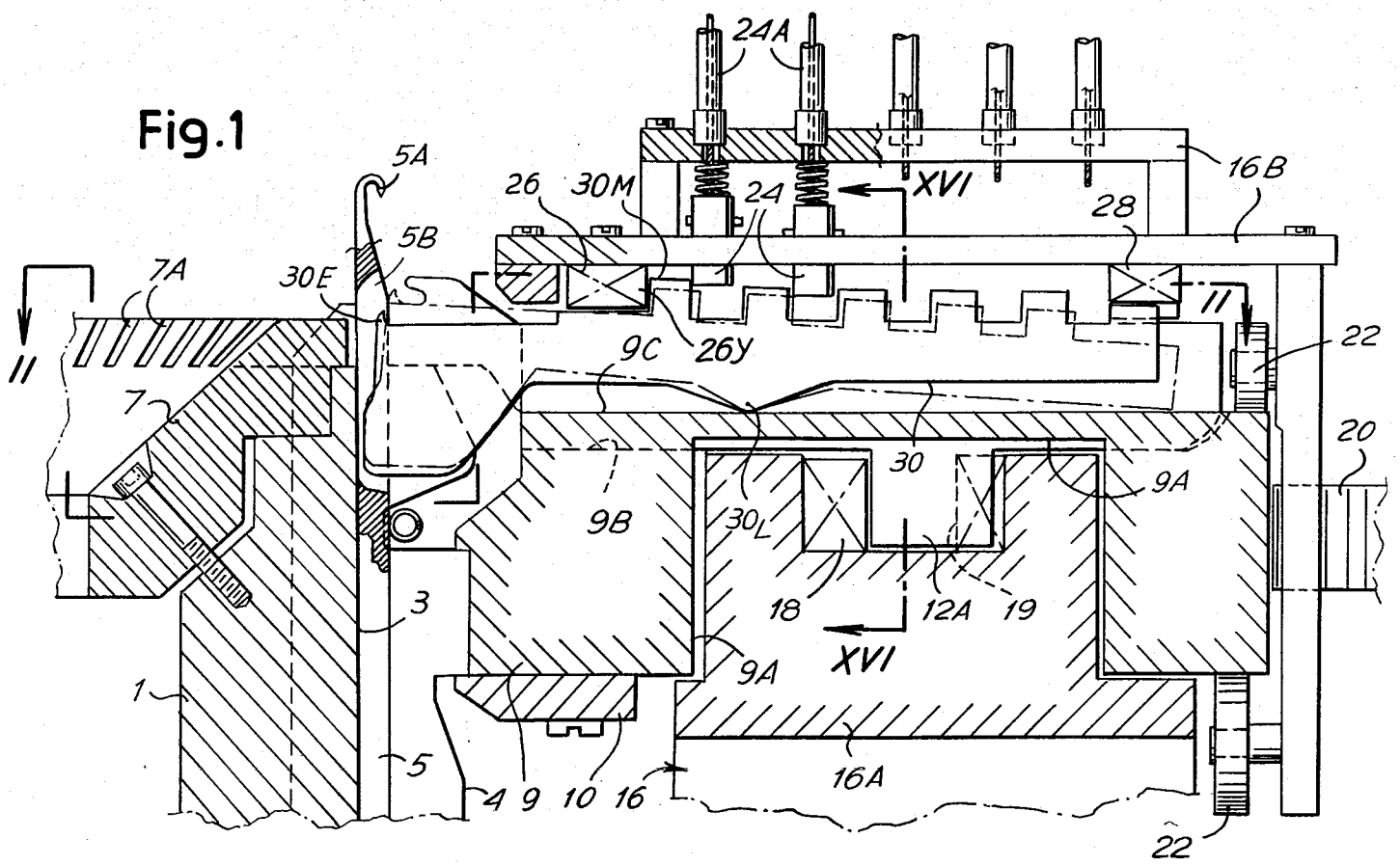
FIG. 1 is a fragmentary section of a circular knitting machine in accordance with the present invention, the section being taken on line I—I of FIG. 2.

In the drawings the reference numeral 1 indicates a needle cylinder having longitudinal grooves or tricks 3 defined by the bars 4 and slidably receiving needles 5 which are described in detail hereinafter. The reference numeral 7 indicates an inner ring of the needle cylinder 1 which is located at the top end of the needle cylinder and is provided with radial slots 7A for radial sinkers. The bars 4 reach the level of the slots 7A. The reference numeral 9 indicates an outer ring, which is fixed in conventional manner to the outside of the needle cylinder 1 adjacent to the upper end thereof, by means of clamps 10.

In the example shown, the outer ring 9 is formed with a large lower annular recess 9A. The outer ring 9 comprises radial slots 9B, which correspond to the spaces between adjacent needles 5, in order to receive sinkers 12. The slots 9B extend from the upper surface of the ring 9 and are of such a depth that they reach the recess 9A, so that the lower ends of the sinkers 12 project into the recess 9A. Each sinker comprises at least one butt 12A projecting into the recess 9A below the bottom edge of the sinker for controlling the sinker. An annular spring of conventional type, (not shown) may be provided to bias the sinkers in a radially inward direction.

In order to drive the sinkers positively at least in a radially outward direction (or also positively in both radial directions), a structure 16 surrounding the needle cylinder extends below the ring 9 and comprises an annular member 16A, which extends into the recess 9A and which either carries, or is in the form of, cams 18 and possibly 19 for acting radially on the butts 12A of the sinkers 12. The structure 16 can be fixed, or can be angularly adjustable or can be provided with pendular motion.

The reference numeral 16B indicates a further part of the structure 16 surrounding the upper part of the needle cylinder, and this structure comprises supports for rollers 20 and 22 which act to center the part 16B. From the lower surface of the part 16B there project circumferential cam profiles and movable sliding bar cams. In particular, sliding bar cams 24 for radial control are driven vertically by sheathed cables 24A in such a manner as to be moved into either an active or inactive position according to a control program. In addition, annular cam profiles operating vertically, that is parallel to the axis of the cylinder 1, and indicated by 26 and 28 can be constituted either by additional elements or can be fixed or adjustable, for the purpose indicated hereinafter.

Figure 3:
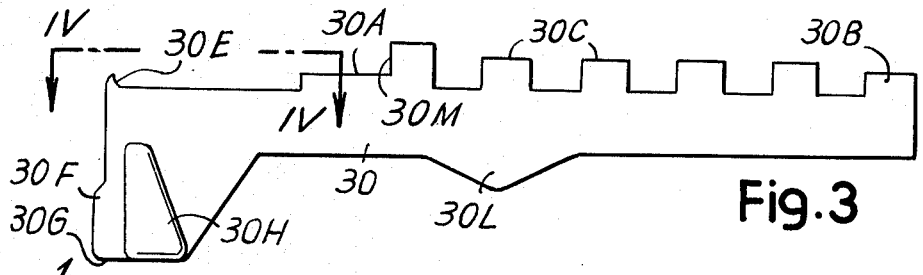
FIG. 3 is a side elevation of a selector element.
Figure 2:
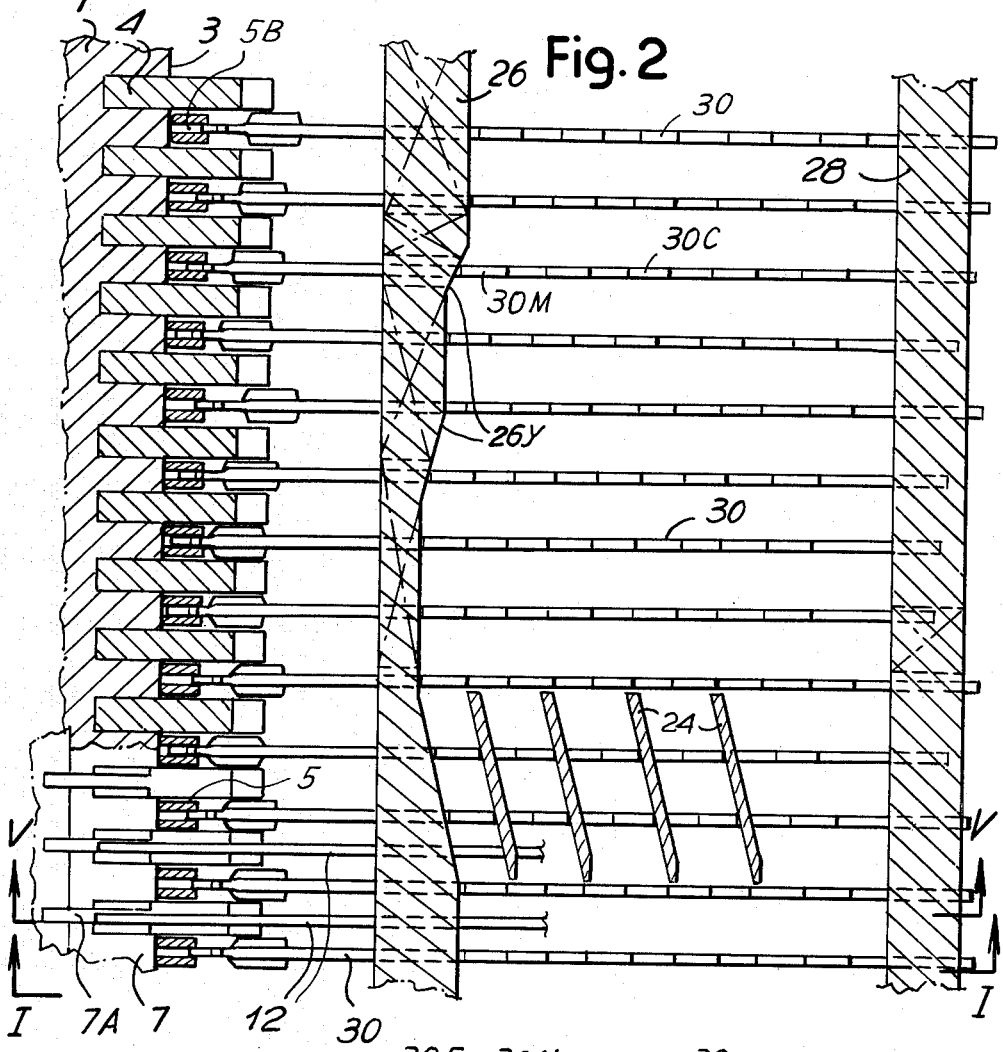
FIG. 2 is a fragmentary section taken on line II—II of FIG. 1.
Figure 4:
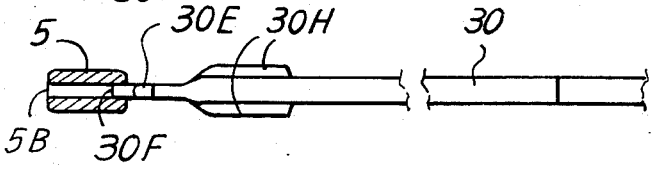
FIG. 4 is a fragmentary section on line IV—IV of FIG. 3.

In intermediate positions between the slots 9B for the sinkers 12 in the outer ring 9, and thus in positions corresponding with the needles 5, there are provided further radial slots 9C, each of which can receive a relatively thin hook-type selector element 30. As shown in FIG. 3, each of these selector elements 30 comprises two upper butt surfaces 30A and 30B designed to co-operate with the annular cam profiles 26 and 28, and at least one butt chosen from a series of selection butts 30C designed to co-operate with the radially acting sliding bar cams 24. The selector element 30 comprises, at its inner end facing towards the axis of the needle cylinder, a hook-like extension 30E which points upwards, a projection 30F extending in a radially inwards direction, and a lower projection 30G which can comprise lateral enlargements in the form of cheeks 30H, for alignment and guiding purposes. Along their lower edges, the selector elements 30 comprise a single point 30L acting as a fulcrum by which the selector element is supported on the base of the associated slot 9C for reciprocatory and angular movement for the purpose indicated hereinafter. Each selector element 30 moves on its point 30L both angularly and rectilinearly in its own plane, this being a plane radial to the cylinder and in which the corresponding needle is also located.

Each needle 5 has a hook **5*a* at its upper end portion, the hook 5*a* being directed vertically instead of being inclined outwards, as occurs in conventional latch needles. In addition, the needles 5 each comprise a longitudinal slot 5B analogous to that provided for receiving a latch. This slot 5B can be a through-slot. This slot 5B is arranged to receive the hook-like extension 30E and projection 30F of the selector element 30, which moves radially relative to the needle. The walls of the slot 5B can, for this purpose, be suitably shaped to provide a lead-in if the selector element 30 enters or leaves the slot 5B, but this is not necessary if the projection 30F always remains at least partly inserted in the slot 5B, even in the radially outermost position of the element 30**.

The needles 5 and hook-type selector elements 30 are controlled in such a manner as to co-operate synchronously for the purpose indicated hereinafter. The needles 5 are raised and lowered—for each feed—by constant limited amounts and without any lifting selection, except for that provided at the commencement of knitting. This dispenses with the need for needle selection systems comprising selectors or jacks with several butts and control cams therefor controlled by program drums or the like. As a consequence of this, the required lift for controlling the needles is much smaller than that required in conventional machines.

In order to make the selection corresponding to the conventional selection for either removing or not removing the stitch from the needle, the selector elements 30 are operated by the movable sliding bar cams 24 for radial control, and according to whether the butts 30C are present or absent, the elements 30, preselected by the program or design, are either advanced radially inwardly or not advanced, until the hook-like extension 30E of each selector element, which has been advanced, penetrates into the needle slot 5B, the hook-like extension then being lifted and extracted radially from the slot. This is effected selectively by the selector elements 30 corresponding to the needles from which the stitches are to be removed. The cam profile 26 is formed in such a manner as to cause the hook-like extension 30E of the hook-type selector 30 to descend at the correct time to below the plane of the sinkers 12, by angular movement about the pivot point 30L, when the selector element 30 has been advanced radially inward in order to penetrate into the slot 5B of the previously raised needle 5.

The cam profile 28 imposes (and the profile 26 allows) lifting of the hook-like extension 30E after penetration into the needle slot 5B, and before and during the return of the selector element 30 in a radially outward direction. The selector element 30 is returned radially outwardly before the needle is lowered. This movement is effected with the hook-like extension 30E raised, and hence the stitch previously formed with a yarn $F_o$ is displaced by the selector element 30 outside the zone of action of the hook 5A of the needle, so that this stitch can then be taken from the needle simply by lowering the hook-like extension 30E after lowering the needle, below the sinker plane. However, if the selector element 30 has not been advanced so that its hook-like extension 30E has not been inserted into the needle slot, the stitch of the yarn $F_o$ is not removed from the trajectory of the hook 5A, and is therefore taken up and retained by the hook 5A (FIG. 15), so as to constitute a retained stitch. The selection between released stitches and retained stitches is therefore determined by a selection of the elements 30 in the sense of selecting those which are to be advanced radially inwardly in accordance with a program obtained by the operation of the cams 24 and the presence or absence of individual butts 30C in the rows of butts present on the assembly of selector elements 30.

Figure 8:
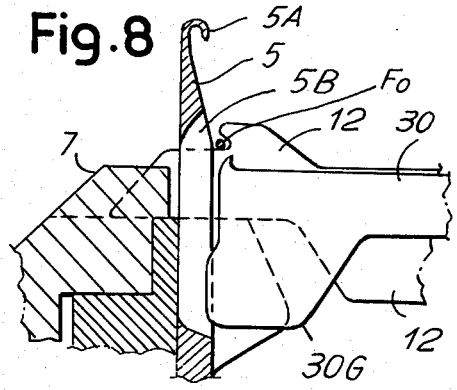
Figure 9:
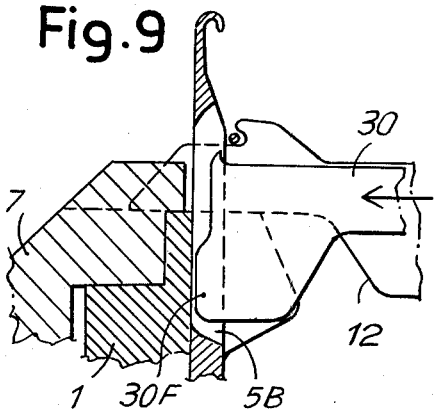
Figure 10:
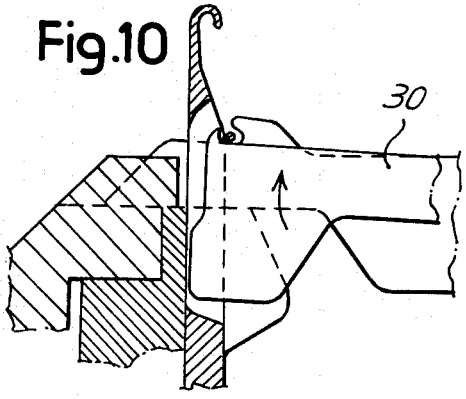
Figure 11:
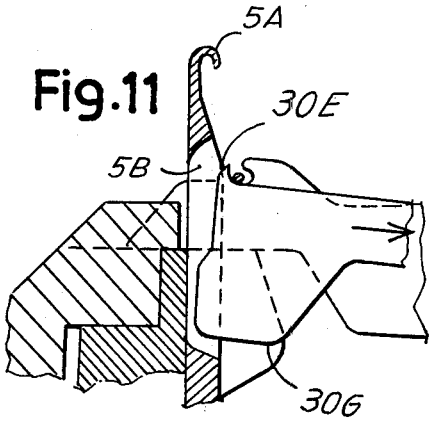
Figure 12:
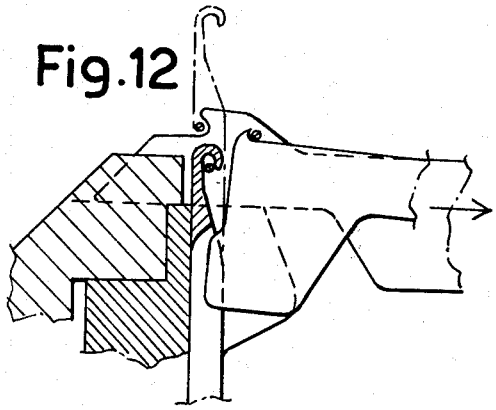
Figure 13:
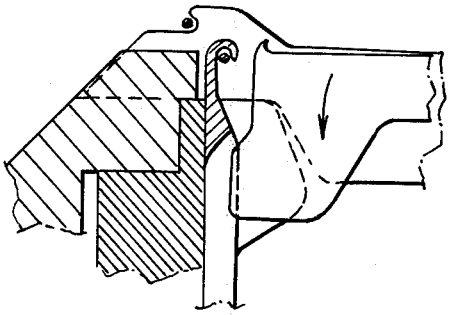

Thus, in FIG. 8, the needle 5 is in a raised position and a yarn $F_o$ is located on the throat of the sinker 12. As shown in FIG. 9, one of the elements 30 is advanced radially inwardly into the hook-like extension 30E of the element 30 penetrates into the needle slot 5B. The hook-like extension 30E then, as shown in FIGS. 10 and 11, is respectively lifted and extracted radially from slot 5B thereby engaging the yarn $F_o$. The selector element 30 is returned radially outwardly, with the hook-like extension 30E raised, the sinker 12 is advanced radially inwardly, and the needle 5 is lowered to a position where a new yarn is placed in the yarn engaging member, that is, the hook of the needle, as shown in FIG. 12. The hook-like extension 30E is lowered to permit taking of the stitch therefrom after the needle is lowered below the sinker plane, as shown in FIG. 13. In FIG. 14, the sinker 12 retracts and the needle 5 is returned to the raised position so that the process may be repeated.

The pivotal and rectilinear movements of the selector elements are obtained by the cam profiles 26 and 28 and cams 24, as shown in FIGS. 1 to 17. For each yarn feed, as shown in FIG. 17, the profile 28 comprises a downwardly-inclined portion 28A and a lower horizontal portion 28B corresponding to a portion of the path of the needles in which the needles 5 have already been raised and the selector elements 30 have already been advanced radially inwardly by the cam or cams 24 active at that time. It should be noted that this lowering can be effective on all the selector elements 30 irrespective of whether they are advanced. By lowering the radially outer end of a selector element 30, the profile 28 raises its hook-like extension 30E after it has penetrated into the slot 5B in the needle.

The cam profile 26 is inoperative over the portions 28A–28B of the profile 28. A lower horizontal portion 26A of the profile 26 keeps the hook-like extension 30E lowered during the radially inwards advance of the selector element 30 (path 30X in FIG. 17) by means of the active cam 24. During the action of the portions 28A, 28B, a raised horizontal portion 26B of the profile 26 is inactive. During the action of the portion 28B, the raised hook-like extension 30E is withdrawn (path 30Y), this being done by means of an outer radial contour 26Y on the cam profile 26, which acts on a butt 30M of the selector element 30. The action of the contour 26Y takes place as the needle begins to lower (path 5Y). When the action of the portion 28B ceases, the withdrawn hook-like extension 30E is lowered by inclined portion 26C of the profile 26 and the stitch hooked by the hook 30E is thereby dropped from the needle which in the meantime has also been lowered (path 5Z) below the sinker plane.

Even when the hook-like extension 30E is withdrawn, the projection 30F of the selector element remains in the slot 5B and keeps the extension 30 aligned with the needle; this can also be aided by the possible presence of the cheeks 30H, which are guided by the bars 4 of the grooves for the needles 5. The cheeks 30H could also replace the projection 30F in its guide and alignment function.

Figure 18:
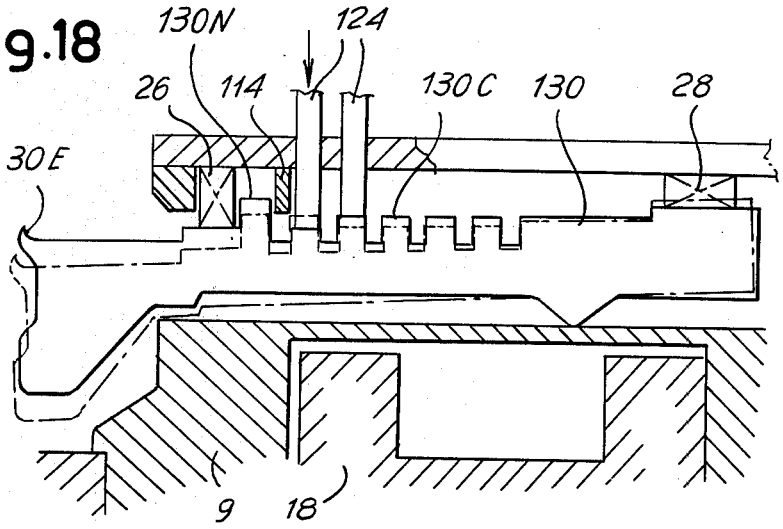
FIGS. 18 to 19 are vertical and horizontal fragmentary sections of a modified embodiment.
Figure 19:
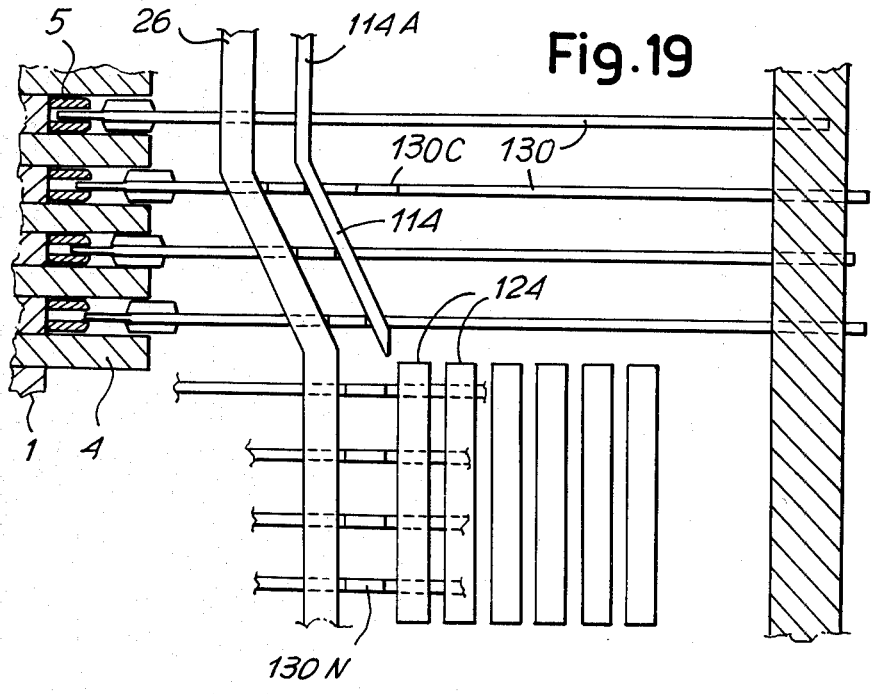

In the embodiment shown in FIGS. 18 and 19, a different selection system for the hook-type selector elements is provided. This system comprises a group of selection cams thrusting against hook-type selector elements 130. In this embodiment, in which members equivalent to those in the previously described embodiment are given the same reference numerals, there is provided a single advancing cam 114, which acts on butts 130N of those selector elements 130 which have not been lowered, the lowered selector elements 130 not being advanced. Those selector elements 130 which are not to be advanced are lowered by movable selection cams 124 which act on butts 130C which are present according to the particular pattern. The extent of lowering imposed by the cams 124 is relatively greater than that imposed by the portion 28A of the cam profile 28. The advancing cam 114 and its extension 114A ensure that the selector element is in its advanced position during the raising of the hook-like extension 30E. The other operations take place in the manner already described.

The embodiments described provide many advantages over conventional designs using a latch needle or a resilient needle.

The elimination of the latch needle eliminates the consequences of frequent breakages of the latches and needles. The needle stroke is reduced because the stitch does not now have to pass under the latch, and thus the stitch does not have to be removed from the needle by lowering it. The sinkers do not wear to the extent which occurs when latches are present. The yarn guides can be moved closer to the moving needles as these do not have an open latch (which could project at 90° to the needle with the corresponding risk of striking against the yarn guide). The yarn guide mouthpiece now serves no purpose and can be dispensed with, but if it is kept it does not have to be constructed of hard material (such as ceramic) to reduce the wear due to the rubbing of the latches. Selection is carried out by moving the hook-type selector elements, the movements being very limited both with regard to their angular extent and to their radial extent. This necessitates only limited ramp lengths on the cam profiles. For raising the needles, no selection is required.

The above arrangements permit an increase in speed, and a reduction in the space required for the control cam profiles. The needles require no selection, other than the fixed conventional selection required to commence knitting.

Compared with resilient needles, there are further advantages in the smaller needle stroke and the much more limited wear.

In a modified arrangement (not shown) selection could be carried out with an equal stroke for all the hook-type selector elements 30 or 130, and by raising only those selector elements 30 or 130 which have to remove the stitch.

Although the invention has been described with particular reference to circular knitting machines, it is equally applicable to all other types of knitting machines which conventionally operate with latch needles.

Although in the embodiment described, the needles are directed vertically the needles need not necessarily be vertical, and the terms "raised" and "lowered" and like terms as used in the appended claims are not to be construed as restricting the claims to an arrangement in which the needles are vertical.

What is claimed is:

1. In a knitting machine, the improvement comprising latchless needles each having means defining a longitudinal slot therein and a yarn engaging member for engaging a stitch of a yarn, hook-type selector elements slidable generally perpendicularly to the needles and movable between raised and lowered positions along the length of the longitudinal slot of the needle, each selector element having a hooked end portion arranged to extend into the said longitudinal slot of an associated needle, and control means selectively operative to move the selector elements generally perpendicularly to the needles and to raise and lower the selector elements so that their hooked end portions can enter the slots in the associated needles, be raised in order to take-up the stitch engaged by the needle and to remove it therefrom, and then be lowered to remove the stitch by lowering the hooked end portion under the plane of formation of the fabric formed by intermeshing loops of the yarn, wherein each of said selector elements comprises butts, and means defining a fulcrum supporting the selector element for sliding movement perpendicularly to its associated needle and supporting the selector element for angular movement between raised and lowered positions, the butts of the selectors cooperating with the control means, and said control means being operable to selectively engage the butts on the selector elements.

2. A knitting machine according to claim 1, wherein the control means comprises cam means cooperating with the butts.

3. A knitting machine as claimed in claim 1, wherein the control means effects advance towards the needle of one of said selector elements which is required to withdraw a stitch and to remove it from the respective needle, lowers said selector before entry into the needle slot, raises said selector before removal from the needle slot, and removes the selector before the needle is lowered.

4. A knitting machine according to claim 1, wherein each selector element comprises a portion which is always at least partly located in the said slot of the associated needle.

5. A knitting machine according to claim 1, wherein each longitudinal needle slot has opposed longitudinal sides, and each selector element comprises lateral projections cooperating with the sides of the slot in the associated needle to guide the selector element therein.

6. A knitting machine according to claim 1, further comprising sinkers, a support structure having means defining slots, said sinkers and said selector elements being mounted in said slots with said sinkers and selector elements being in alternating relation, and control means for the sinkers, the sinker control means and the selector element control means being arranged at opposite sides of said structure.

7. In a knitting machine, the improvement comprising latchless needles each having means defining a longitudinal slot therein and a yarn engaging member for engaging a stitch of a yarn, hook-type selector elements slidable generally perpendicularly to the needles and movable between raised and lowered positions along the length of the longitudinal slot of the needle, each selector element having a hooked end portion arranged to extend into the said longitudinal slot of an associated needle, and control means selectively operative to move the selector elements generally perpendicularly to the needles and to raise and lower the selector elements so that their hooked end portions can enter the slots in the associated needles, be raised in order to take-up the stitch engaged by the needle and to remove it therefrom, and then be lowered to remove the stitch by lowering the hooked end portion under the plane of formation of the fabric formed by intermeshing loops of yarn, and wherein each selector element comprises a portion which is always at least partly located in the said slot of the associated needle.

* * * * *